US005635952A

United States Patent [19]

Gable

[11] Patent Number: 5,635,952

[45] Date of Patent: Jun. 3, 1997

[54] ADAPTOR ENABLING COMPUTER SENSING OF MONITOR RESOLUTION

[75] Inventor: John Gable, San Jose, Calif.

[73] Assignee: Enhance Cable Technology, San Jose, Calif.

[21] Appl. No.: 93,154

[22] Filed: Jul. 19, 1993

[51] Int. Cl.[6] ..... G09G 5/00

[52] U.S. Cl. ..... 345/132; 395/883; 345/1

[58] Field of Search ..... 345/1, 3, 11, 132; 395/882, 883; 439/638, 651, 654, 655

[56] References Cited

U.S. PATENT DOCUMENTS 5,276,458 1/1994 Sawdon ..... 345/132

OTHER PUBLICATIONS

A.J. Morrish, "Improved Method of Monitor Identification and Mode Control", IBM Technical Disclosure Bulletin, vol. 33, No. 5, Oct. 1990; pp. 289–291.

*Primary Examiner*—Kee M. Tung
*Assistant Examiner*—Matthew Luu
*Attorney, Agent, or Firm*—Ralph C. Francis

[57] ABSTRACT

An adaptor for coupling a display monitor to a computer that controls the monitor generates any selected one of a number of codes that can be sensed by the computer and which identify the image resolution at which the particular monitor operates or a resolution that has been selected by the operator in the case of multi-sync monitors. A rotary hexadecimal switch, which may be operated by turning a dial, simplifies code selection and a multi-channel dip switch enables expansion of the number of available codes. The dip switch also enables selective changing of sync signal connections within the adaptor to accommodate to different monitors that have different sync signal input requirements. The adaptor may be a separable unit which can be interconnected between the computer and monitor or may be a permanent built in component of the monitor image data input cable.

20 Claims, 5 Drawing Sheets

ADAPTOR ENABLING COMPUTER SENSING OF MONITOR RESOLUTION

TECHNICAL FIELD

This invention relates to the interfacing of computers and image display monitors and more particularly to cable adaptors which enable a computer to identify the image resolution which is required by the particular monitor to which the computer is connected or a resolution which has been selected by the operator.

BACKGROUND OF THE INVENTION

Video monitors which display images generated by a computer are manufactured in a variety of types and in a variety of sizes. Different monitors require different control signals from the computer. Some monitors require control signals from the computer that establish a single specific degree of resolution in the image and the required resolution is different in different types of monitor. Most newer monitors are designed to enable operator selection of any of several specific resolutions. Thus the computer must provide different control signals to different monitors or to a single monitor if the operator wishes to change resolution.

Newer computers of the well known type manufactured by Apple Computer, Inc. and which are generally referred to by the trademarked name "Macintosh" or "Mac" are available with an internal monitor controller built into the motherboard and which is known as "On Board Video". The controller is designed to sense the type of monitor to which it is connected provided that the monitor contains components which generate a resolution code that identifies the required resolution. The computer then provides monitor control signals that establish that particular resolution.

The original resolution coding, termed the "Sense Line Protocol" by Apple Computer, Inc., provided for seven different resolution codes. The system has since been extended and expanded to provide for additional codes.

Monitors designed for use with other types of computer, such as the MS-DOS type manufactured by IBM Corporation for example, do not have the resolution code generating components and also have cable connectors that differ from those of the Macintosh computers. Many of these monitors have capabilities that can be highly useful to users of Macintosh computers.

Adaptors have recently been introduced to the market which are designed to enable interfacing of the otherwise incompatible monitors and Macintosh computers. Adaptors of this kind have a pin conector at one end that engages in the video port of the computer and a differing connector at the other end that conforms with the connector at the end of the monitor image data input cable. These recently commercialized adaptors also contain components for producing the resolution code that the computer needs to sense in order to provide a resolution that is appropriate to the particular monitor but are subject to a number of limitations in this respect.

Some adaptors of this kind are hardwired and thus can produce only a single code. This requires that a series of differing adaptors be manufactured in order to meet the needs of different monitors and/or to provide different resolutions. Other adaptors of this kind enable selection of any of a series of codes but have switching arrangements, such as plural dip switches that are difficult to adjust and which can be confusing to the user.

The adaptors do not address other problems that can be encountered in interfacing monitors and computers including monitors and computers of the same manufacture. For example, such adaptors do not enable adjustments to accommodate to the different synchronization signal input requirements of different types of display monitor.

The present invention is directed to overcoming one or more of the problems discussed above.

SUMMARY OF THE INVENTION

In one aspect, the present invention provides an adaptor for interconnecting a display monitor with a computer which provides image data to the monitor and which computer includes means for sensing resolution codes that identify the resolution at which the monitor is to operate. The adaptor includes a first connector having means for engagement with the computer and having a first plurality of signal channels for receiving image data from the computer. The first connector also has a plurality of sense lines for enabling detection of the resolution codes by the computer. Output means transmits the image data to the monitor and has a second plurality of signal channels which are connected to the first plurality of signal channels. Manually operable rotary switch means provide for selectively establishing any selected one of a plurality of different electrical conditions at the sense lines, each of the conditions being a different resolution code that identifies a different monitor resolution.

In another aspect of the present invention, the adaptor further includes means for selectively establishing unidirectional current flow paths between selected ones of the sense lines.

In another aspect of the present invention, the rotary switch means is a hexadecimal switch having first, second and third terminals respectively connected to a first and a second and a third sense line. The switch has a plurality of switch settings including settings at which different combinations of the sense lines are interconnected by the switch.

In another aspect, the invention provides an adaptor for coupling a display monitor to a computer which transmits image data to the monitor and which has means for sensing resolution codes that identify the resolution at which the monitor is to operate. The adaptor includes a first connector having means for engagement with the computer and having a first plurality of signal channels for receiving image data from the computer. The first connector also has a plurality of sense lines for enabling detection of the resolution codes by the computer. Output means transmits the image data to the monitor and has a a plurality of signal channels which are connected to the first plurality of signal channels. Manually operable switch means provide for selectively establishing any selected one of a plurality of different electrical conditions at the sense lines, each of the conditions being a different resolution code that identifies a different monitor resolution. Further components include a plurality of diodes and a plurality of diode selector switches, each sense line being selectively connectable with each other sense line through a different one of the diodes and a different one of the diode selector switches.

In another aspect, the invention provides an adaptor for coupling a display monitor to a computer which transmits image data to the monitor, the adaptor having a first connector which includes means for engagement with the computer and which has a first plurality of signal channels for receiving image data from the computer including sync signal channels. Output means transmits the image data to the monitor and has a second plurality of signal channels which are connected to the first plurality of signal channels. The adaptor further includes sync signal routing means for enabling changing of the interconnections between sync signal channels of the first connector and channels of the output means.

The invention enables interconnection of computers and display monitors which otherwise may have incompatible characteristics such as a lack of resolution code generating means in the monitor and/or differing cable connector configurations. Preferred embodiments are also capable of adjusting sync signal output to match the differing needs of different types of monitors. In a preferred form, the adaptor engages with the connector at the end of the monitor input signal cable and with the video port of the computer and has a rotary dial that may be set to generate any of the standard resolution sense codes thereby enabling the computer to generate monitor control signals that are compatible with the particular monitor or to change resolution as desired by the operator. Any resolution sense code in the extended and the expanded ranges can be generated by setting selected ones of a bank of additional switches in conjunction with setting of the rotary dial. The adaptor may be a separate unit that is engagable with both the computer and the monitor or may be a permanent built in component of the monitor input cable.

The invention, together with further aspects and advantages thereof, may be further understood by reference to the following description of the preferred embodiments and by reference to the accompanying drawings.

DETAILED DESCRIPTION OF THE PREFERRED EMBODIMENTS

Figure 1:
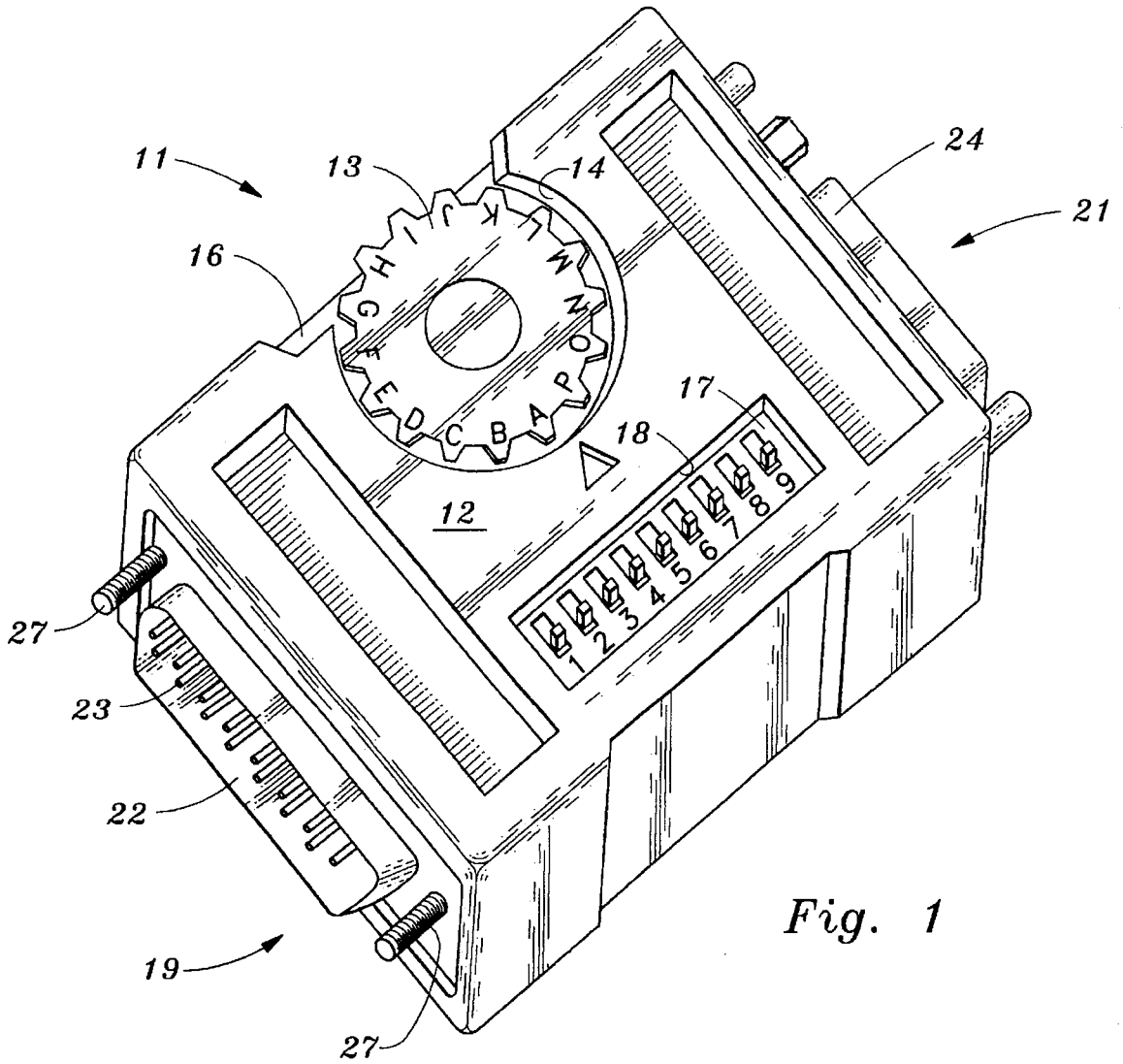
FIG. 1 is a perspective view of a monitor adaptor in accordance with a first embodiment of the invention.
Figure 2:
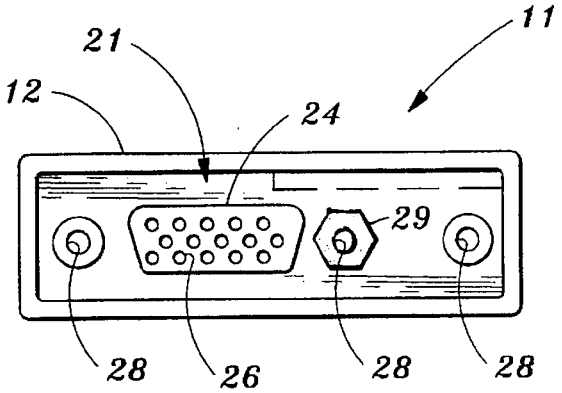
FIG. 2 is an end view of the adaptor of FIG. 1 depicting the connector which engages with a monitor cable.

Referring initially to FIGS. 1 and 2 of the drawings, a display monitor adaptor 11 in accordance with this embodiment of the invention has a body 12 which may be of generally rectangular shape and which may be formed of molded plastic, for example. External controls include a rotary dial 13 which is preferably situated in a conforming recess 14 in the top of the body 12 and which extends to a slot 16 at one edge of the body to facilitate turning of the dial by the operator's thumb. A nine channel dip switch 17 is situated within another conforming recess 18 in the top of body 12.

A first connector 19 for engagement with the video port of a computer is situated at one end of body 12 and a second connector 21 at the other end of the body engages with the control signal input cable of a display monitor and functions as output means for transmitting image data to a monitor. The adaptor 11 of this example of the invention is designed for use with Mac computers of the type manufactured by Apple Computer, Inc. Thus the first connector 19 is a male pin connector of the standardized D-SUB 15 type which has an elongated shell 22 and two rows of connector pins 23, there being eight pins in the upper row and seven pins in the lower row.

This embodiment of the adaptor 11 enables computers of the above described type to control display monitors which were originally designed for use with computers of the MS-DOS type such as are manufactured by IBM Corporation. Thus the second connector 21 has a different configuration and is a female connector of the standardized HD-SUB 15 form which has a smaller shell 24 and three rows of pin receptacles 26 with five receptacles in each row.

Thumbscrews 27 of the standardized type extend from one end of the adaptor 11 to the other end adjacent the sides of body 12 to provide for a threaded engagement of the adaptor with the computer port. The heads of the thumbscrews are provided with threaded bores 28 to enable a similar threaded engagement of a monitor cable connector with the adaptor. In the present embodiment, a third head 29 with a threaded bore 28 is situated between the thumbscrews 27 and adjacent connector shell 24 to enable the threaded engagement with the smaller HD-SUB 15 connector at the end of the monitor cable.

Figure 3:
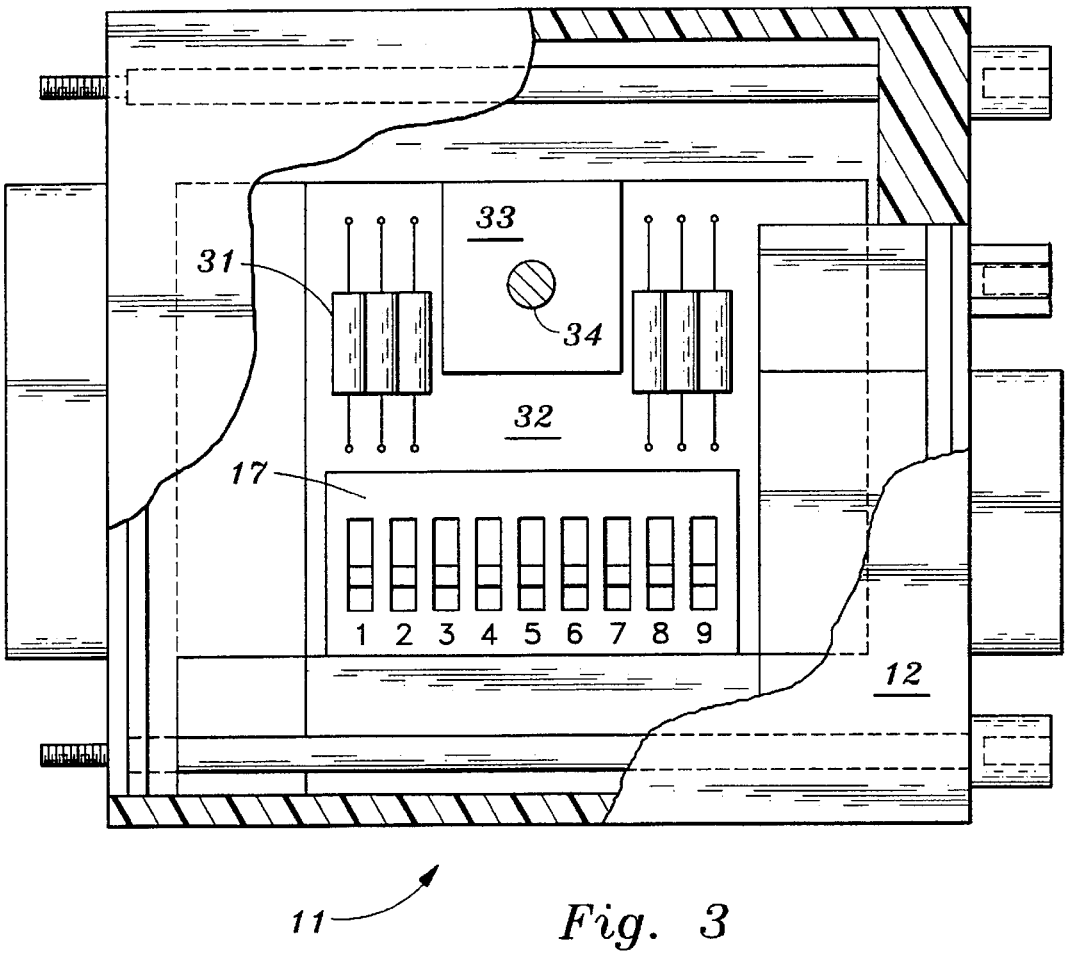
FIG. 3 is a broken out top view of the first embodiment showing internal components.
Figure 4:
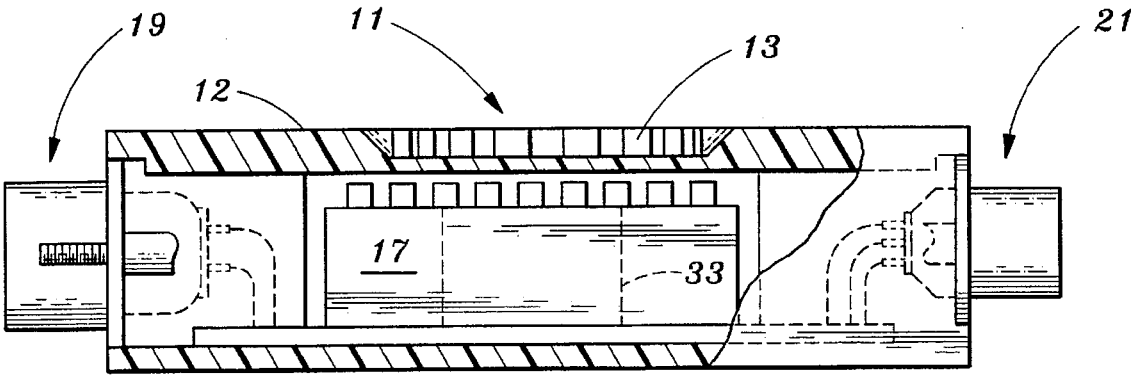
FIG. 4 is a broken out side view of the first embodiment.

Referring jointly to FIGS. 3 and 4, internal components of the adaptor 11 preferably include six diodes 31 attached to a printed circuit board 32 and a hexadecimal rotary switch 33, the electrical connections between such components being hereinafter described. The rotatable shaft 34 of switch 33 is turned by the previously described dial 13.

Figure 5:
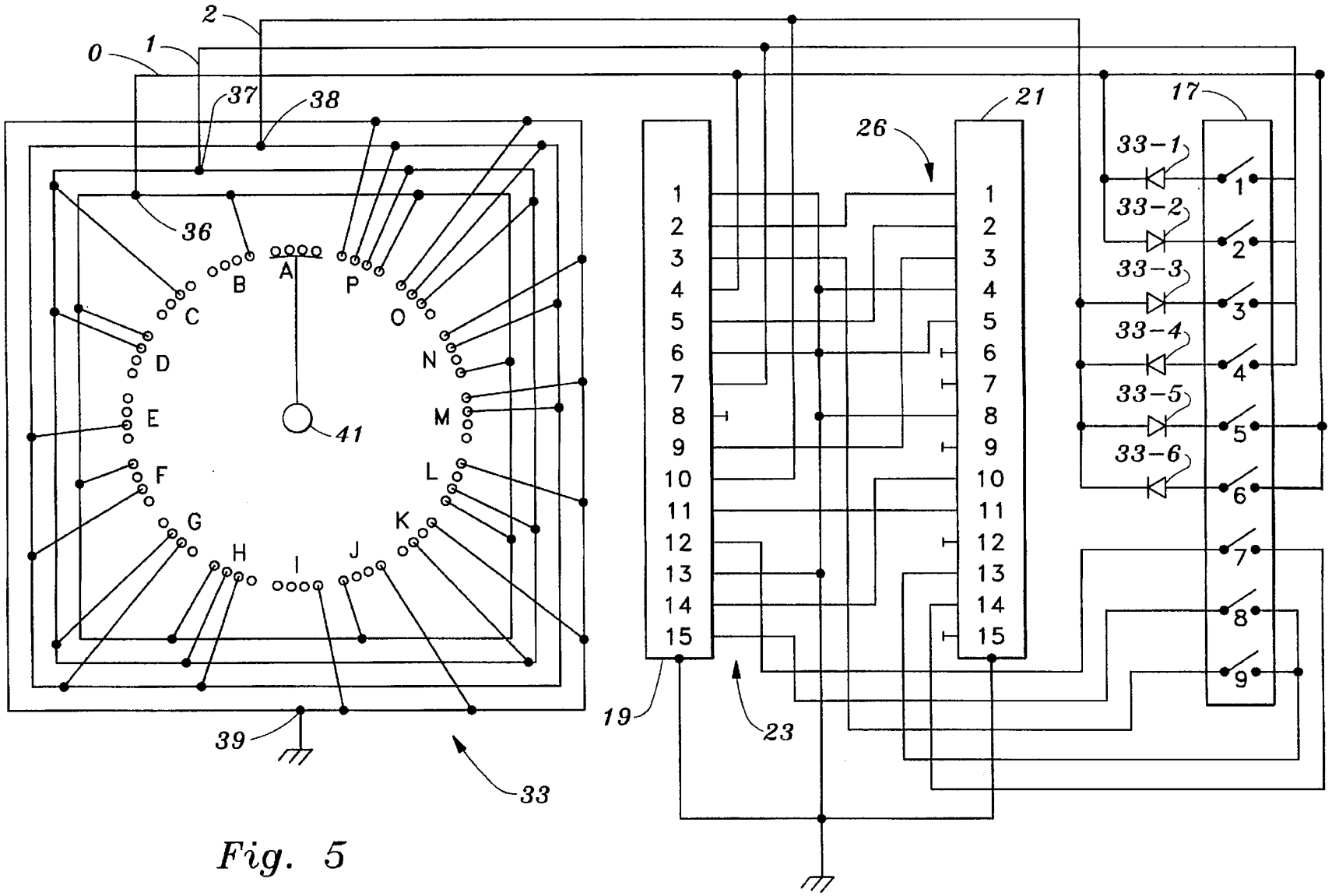
FIG. 5 is a circuit diagram showing electrical components of the first embodiment and interconnections therebetween.

With reference to FIG. 5, the pins 19 and 21 of first and second connectors 19 and 21 are interconnected in the depicted manner to adapt monitors of the above described type to a computer of the above described type although other pinout configurations, known to the art, are used with other types of monitor or computer. Pins 4, 7 and 10 of the first connector 19 are of particular interest in connection with the present invention as these pins connect with the three sense lines 0, 1 and 2 that provide a resolution code to the computer. Sense lines 0, 1 and 2 connect with first, second and third terminals 36, 37 and 38 of the hexadecimal switch 33 and the switch has a fourth terminal 39 that is connected to the connector shells which function as a chassis ground for the circuit.

Hexadecimal switch 33, which may be of the RS 12 type, is a sixteen position switch having a common contact 41 that interconnects different combinations of the switch terminals 36, 37, 38 and 39 at different settings of the switch.

For purposes which will be hereinafter described, a first diode 31-1 is connected between sense lines 0 and 1 through a first switch channel of dip switch 17 and enables a unidirectional current flow from line 1 to line 0 when the switch channel is closed. The second diode 31-2 enables current flow from sense line 0 to sense line 1 when the second channel of dip switch 17 is closed. The third channel may be closed to enable current flow from sense line 2 to sense line 1 through the third diode 31-3 and the fourth channel may be closed to enable current flow from line 2 to line 1 through the fourth diode 31-4. Closure of the fifth channel allows current flow from line 2 to line 0 through diode 31-5 and closure of the sixth channel enables current flow from line 0 to line 2 through the sixth diode 31-6.

Figure 6:
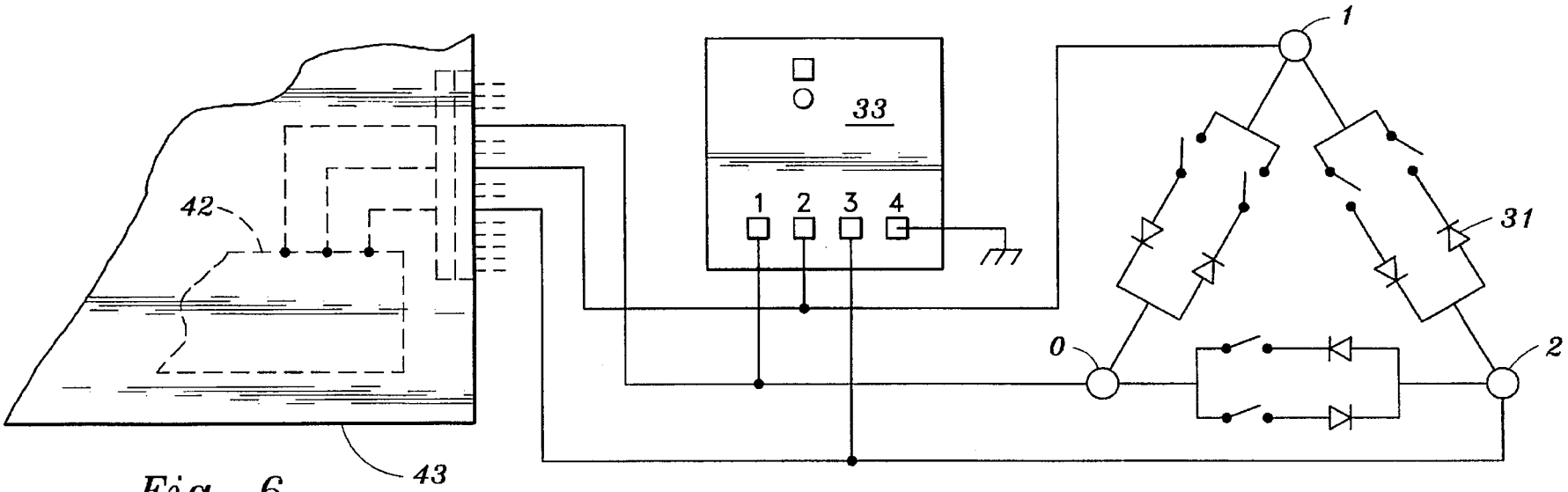
FIG. 6 is another circuit diagram showing portions of the circuit of FIG. 5 with certain components repositioned to facilitate an understanding of the operation of the invention.

Referring to FIG. 6, operation of the resolution code generating components may best be understood by viewing the sense lines 0, 1 and 2, diodes 31 and the switch channels of the dip switch as repositioned in FIG. 6. Electrical connections between such components remain the same as in FIG. 5. Displaying the sense lines 0, 1 and 2 in a triangular relationship as in FIG. 6 conforms with the standardized symbolic depiction of sense codes as provided by the manufacturer.

The On Board Video or monitor controller 42 of the computer 43 detects what resolution is needed by transmitting a voltage to each of the sense lines 0, 1 and 2 to determine if one or more of the sense lines are grounded. A total of seven different standard codes can be generated by grounding individual sense lines or different combinations of sense lines. The computer 43 is programmed to identify particular ones of the codes with particular resolutions at which the monitor is to be operated.

At any of the settings of hexadecimal switch 33 that are identified by letters J to P in FIG. 5, the common contact 41 of the switch connects individual ones of the sense lines 0, 1 and 2 or different combinations of such lines to ground through the grounded switch terminal 39. At setting I, all sense lines are ungrounded. Thus the switch may be set to generate any selected one of the seven standard sense codes to inform the computer of the desired resolution. Referring again to FIG. 1, the letters A to P or other equivalent symbols are displayed at angularly spaced locations around the rotatable dial 13 to identify the sixteen switch settings and the dial may be turned to position any selected letter at a locator arrow 40 which is displayed on the adaptor body 12 at a location that is adjacent the dial. The operator is provided with a listing of the resolutions that are encoded at the different settings identified by the letters or the like, preferably on a label (not shown) that is adhered to the underside of the adaptor body 12.

Referring again to FIG. 6, the newer extended sense codes are produced by a different technique. If the computer 43 initially detects an ungrounded condition at all three sense lines 0, 1 and 2, it is programmed to apply voltage to line 0 and to sense if the voltage also appears on one or both of lines 1 and 2. The computer 43 then applies voltage to line 1 and detects if voltage also appears on one or both of lines 0 and 2. Voltage is then applied to line 2 and the computer detects if the voltage also appears on one or both of lines 0 and 1. The computer 43 assigns a binary value of 0 to the absence of voltage on a sense line to which voltage is not being directly applied and a value of 1 to the presence of voltage on a line to which the voltage is not being directly applied and thereby acquires a six bit binary code which identifies the desired resolution. Different pairs of the sense lines 0, 1 and 2 are interconnected through switch 33 at different settings of the switch and thus the operator may select the particular code that is generated. Referring again to FIG. 5, settings A to H of hexadecimal switch 33 provide the different interconnections of sense lines that produce the extended sense codes.

The range of available sense codes can be further expanded by establishing unidirectional current flow paths between sense lines 0, 1 and 2 rather than two way flow paths. The computer 43 senses a different binary code if a unidirectional path is present as opposed to a two way flow path. Selected ones of the dip switch 17 channels may be closed to establish such unidirectional flow paths. The first six channels of dip switch 17 function as diode selector switches and enable selective interconnection of a diode 31 between any pair of the sense lines 0, 1 and 2 to create a unidirectional current flow path therebetween and selective interconnection of an oppositely oriented diode between any pair of the lines to establish a reversed unidirectional flow path. Referring again to FIG. 1, the channels of dip switch 17 are identified by visible numbers so that the operator may follow instructions which identify the channels that need to be closed to create a given resolution code.

Referring again to FIG. 5, the additional switch channels 7, 8 and 9 of dip switch 17 are used as sync signal routing means for enabling changing of the interconnections between sync signal receiving channels of the first connector 19 and the channels of the second connector 21 as may be needed to accommodate to the different sync signal requirements of different types of monitor. In the present example, a computer of the above identified type transmits a composite sync signal to pin 3 of the first connector 19, a vertical sync signal to pin 12 of that connector and a horizontal sync signal to pin 15 of the connector. Dip switch channel 7 enables selective application of the vertical sync signal from pin 12 of first connector 19 to pin receptacle 14 of the second connector 21. Dip switch channels 8 and 9 are connected in this embodiment of the invention and enable pin receptacle 13 of the second connector 21 to receive either the horizontal sync signal from pin 15 of first connector 19 or the composite sync signal from pin 3 of the first connector depending on the requirements of the particular monitor. The requirements of particular monitors with respect to sync signal input are made available by the manufacturer.

Figure 7:
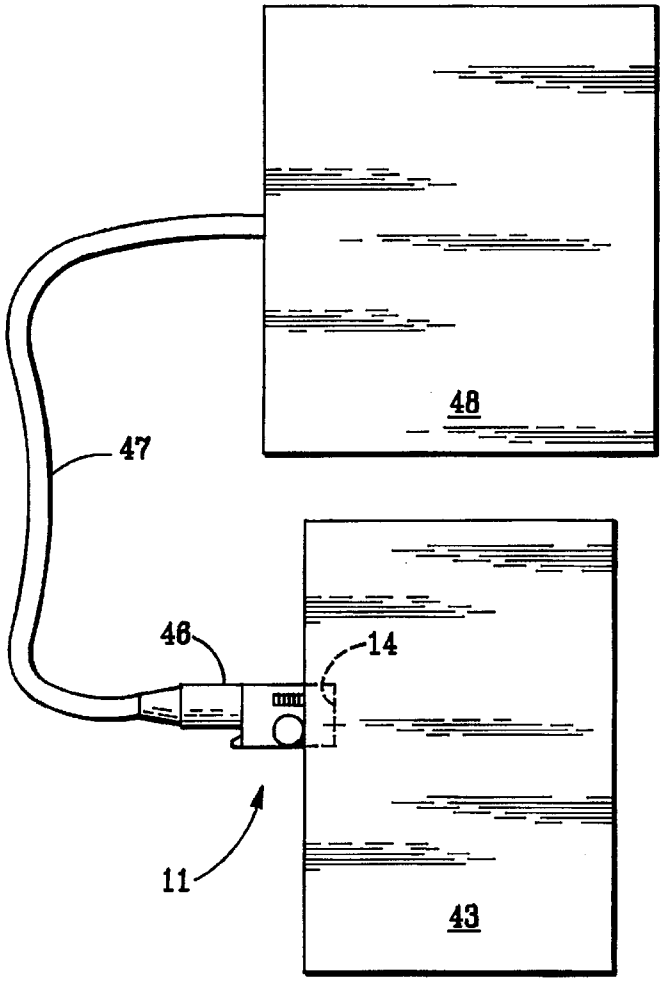
FIG. 7 is a top view showing the adaptor of the preceding figures in engagement with a display monitor and a computer.

Referring to FIG. 7, in use the adaptor is engaged in the video port 44 of the computer 43 in place of the built in connector 46 at the end of the control signal input cable 47 of the display monitor 48. The cable connector 46 is then engaged with the second connector 21 of the adaptor 11.

Figure 8:
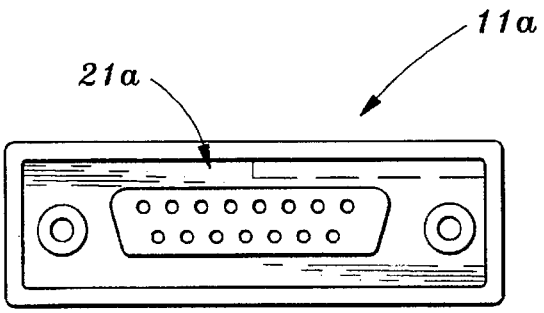
FIG. 8 is an end view of a second embodiment of the invention which has a different connector configuration in order to engage with monitors having a different type of cable connector.
Figure 9:
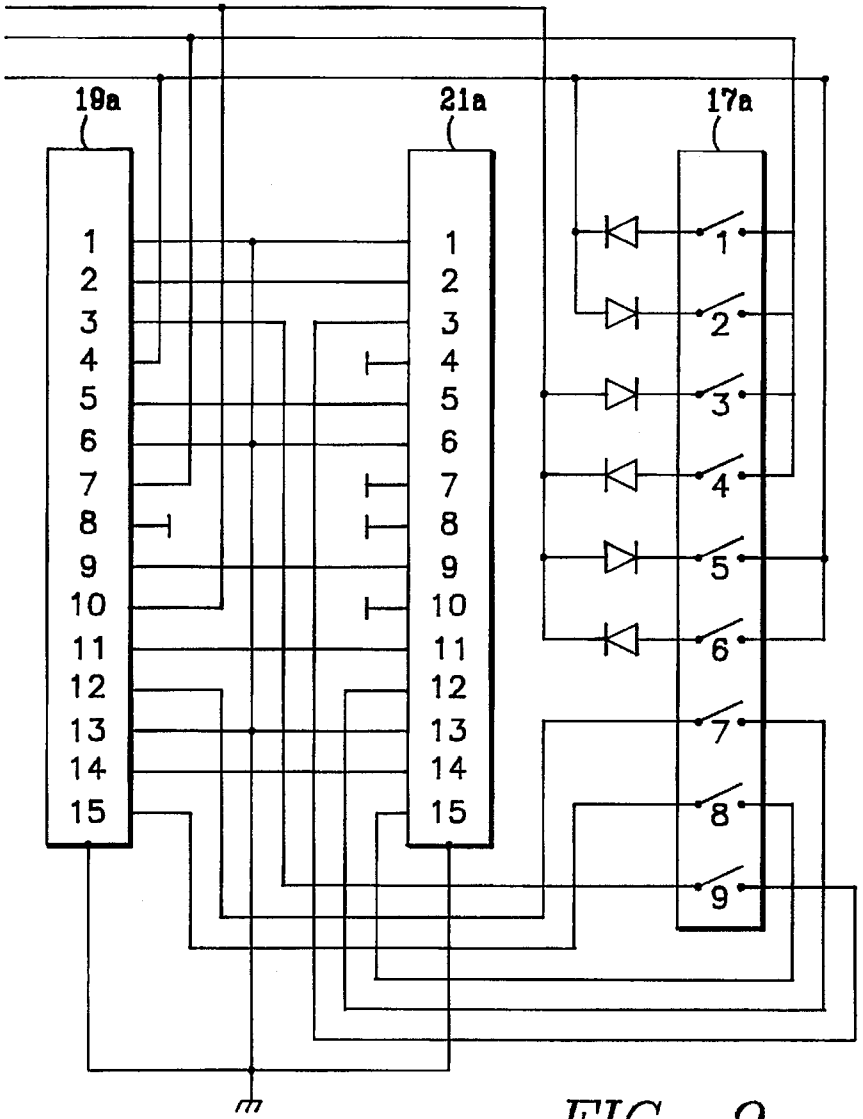
FIG. 9 is a circuit diagram showing connector pin connections that are appropriate for the embodiment of FIG. 8.

The above described embodiment of the adaptor 11 has differing connectors at opposite ends to enable coupling of a Mac computer with a monitor having a different form of input cable connector. Referring to FIG. 8, the second connector **21*a* may be identical to the first connector 19, shown in FIG. 1, in some cases such as in adaptors 11*a* which are designed to couple Mac computers with monitors that were designed for use with that type of computer. This requires a different interconnection of the pins and pin receptacles of the first and second connectors 19*a* and 21*a* and the terminals of dip switch channels 7, 8 and 9 as shown in FIG. 9. The adaptor 11*a*** may otherwise be similar to the first embodiment of the invention as previously described.

Figure 10:
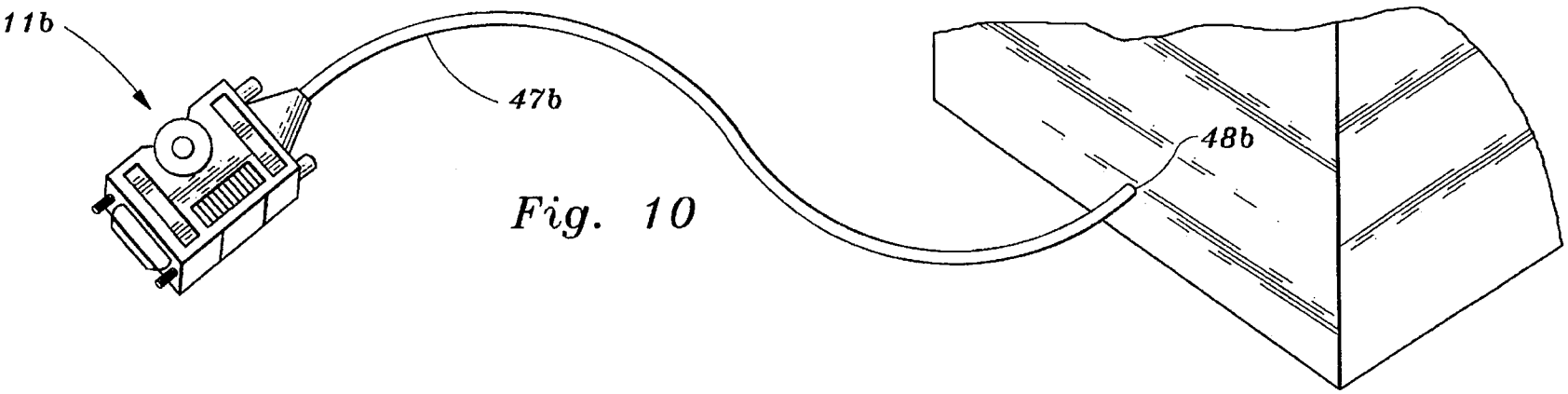
FIG. 10 is a perspective view showing a modification of the invention in which the adaptor is a built-in connector at the end of a display monitor control signal input cable.

The above described adaptors are discrete units that are separable from both the computer and the monitor. Referring to FIG. 10, an essentially similar device **11*b* can replace the connector which is otherwise present at the end of the control signal input cable 47*b* of a monitor 48*b* and thus be a built in component of the cable that is permanently attached to the cable. A second connector of the previously described type is not necessarily required in an adaptor 11*b* of this kind as the signal conductors of the cable 47*b* may be directly connected to the pins of the first connector 19*b* of the adaptor 11*b* and to the dip switch 17*b* in the manner previously described with reference to the pin receptacles of the second connector. The adaptor 11*b*** may otherwise be similar to one of the previously described embodiments of the invention.

While the invention has been described with reference to certain specific embodiments for purpose of example, many variations and modifications of the adaptor are possible and it is not intended to limit the invention except as defined by the following claims.

I claim:

1. An adaptor for interconnecting a display monitor with a computer which provides image data to the monitor and said computer includes means for sensing resolution codes that identify the resolution at which the monitor is to operate, said adaptor being comprised of:

a first connector having means for engagement with said computer and having a first plurality of signal channels for receiving said image data from said computer, said first connector further having a plurality of sense lines for enabling detection of said resolution codes by said computer, output means for transmitting said image data from said first plurality of signal channels to said monitor, said output means having a second plurality of signal channels which are connected to said first plurality of signal channels, and manually operable rotary switch means for selectively establishing any selected one of a plurality of different electrical conditions at said sense lines, each of said conditions being a different resolution code that identifies a different monitor resolution.

2. The adaptor of claim 1 further including means for selectively establishing uni-directional current flow paths between selected ones of said sense lines.

3. The adaptor of claim 1 wherein said adaptor further includes a plurality of diodes and a plurality of diode selector switches and wherein each sense line is connected each other sense line through a different one of said diodes and a different one of said diode selector switches.

4. The adaptor of claim 1 wherein said sense lines include a first and a second and a third sense line and wherein said rotary switch means has a plurality of switch settings each identified with a different one of said resolution codes and wherein different ones of said sense lines are interconnected at different ones of said switch settings.

5. The adaptor of claim 1 wherein said first plurality of signal channels of said first connector includes sync signal channels and wherein said adaptor further includes sync signal routing switch means for enabling changing of the interconnections between said sync signal channels of said first connector and said channels of said output means.

6. The adaptor of claim 1 further including an adaptor body having said first connector at one end thereof and having said output means at the other end thereof, and wherein said rotary switch means includes a rotatable dial for selecting any of a plurality of different switch settings each of which establishes a different one of said plurality of different electrical conditions, said dial being mounted on said body.

7. The adaptor of claim 6 wherein said adaptor body has a surface at which said disk is disposed and wherein dial is a circular disk disposed in parallel relationship with said surface.

8. The adaptor of claim 7 wherein said adaptor body has a recess in said surface in which said disk is disposed and wherein said recess and said disk extend to a side surface of said adaptor body.

9. The adaptor of claim 1 wherein said sense lines include a first and a second and a third sense line and wherein said rotary switch means is a hexadecimal rotary switch having first, second and third terminals respectively connected to said first, second and third sense lines and having a plurality of switch settings including settings at which different combinations of said sense lines are interconnected by said rotary switch means.

10. The adaptor of claim 9 wherein said hexadecimal rotary switch has a fourth terminal which is grounded and has a common contact which is selectively connectable to individual ones of said terminals and to different combinations of said terminals, said rotary switch having sixteen switch settings including a setting at which said terminals are electrically isolated from each other, three settings at which said fourth terminal is isolated from said common contact and at which different individual ones of said first, second and third terminals are contacted thereby, four settings at which said fourth terminal is isolated from said common contact and at which different combinations of said first, second and third terminals are interconnected with each other, another setting at which said fourth terminal is contacted by said common contact and each of the other terminals is isolated therefrom and from each other, and seven settings at which said fourth terminal is contacted by said common contact and at which different single ones of said first, second and third contacts and different combinations of said first second and third terminals are contacted by said common contact.

11. The adaptor of claim 9 further including a plurality of diodes and a dip switch having a plurality of diode selector switches, either of a first pair of said diodes being connectable to form a unidirectional current flow path between said first and second terminals by actuation of a selected one of a first pair of said selector switches, either of a second pair of said diodes being connectable to form a unidirectional current flow path between said second and third terminals by actuation of a selected one of a second pair of said selector switches, a third pair of said diodes being connectable to form a uni-directional current flow path between said first and third terminals by actuation of a selected one of a third pair of said selector switches, said diodes of each of said pairs being oriented to transmit current in opposite directions.

12. The adaptor of claim 11 wherein said first plurality of signal channels of said first connector includes a composite sync signal channel and a horizontal sync signal channel and a vertical sync signal channel and wherein said dip switch has additional switch means for optionally connecting said composite sync signal channel with a first signal channel of said output means and for connecting a selected one of said horizontal sync signal channel and said vertical sync signal channel with a second signal channel of said output means.

13. The adaptor of claim 1 wherein said output means includes a second connector having means for electrically coupling said second plurality of signal channels to said monitor.

14. The adaptor of claim 13 wherein said first connector is a male connector having a plurality of pins and said second connector is a female connector having a plurality of pin receptacles, said pins and pin receptacles being arranged in different patterns and having different spacings.

15. The adaptor of claim 13 wherein said first connector is a male connector having a plurality of pins and said second connector is a female connector having a corresponding plurality of pin receptacles, said pins and pin receptacle being arranged in the same pattern and having the same spacing.

16. The adaptor of claim 1 wherein said output means includes a monitor image data input cable, said adaptor being permanently attached to said image data input cable.

17. An adaptor for coupling a display monitor to a computer which transmits image data to the monitor and which computer has means for sensing resolution codes that identify the resolution at which the monitor is to operate, said adaptor being comprised of:

a first connector having means for engagement with said computer and having a first plurality of signal channels for receiving said image data from said computer, said first connector further having a plurality of sense lines for enabling detection of said resolution codes by said computer, output means for transmitting said image data to said monitor, said output means having a plurality of signal channels which are connected to said first plurality of signal channels, manually operable switch means for selectively establishing any selected one of a plurality of different electrical conditions at said sense lines, each of said conditions being a different resolution code that identifies a different monitor resolution, a plurality of diodes and a plurality of diode selector switches, each sense line being selectively connectable with each other sense line through a different one of said diodes and a different one of said diode selector switches.

18. The adaptor of claim 17 wherein said sense lines include first, second and third sense lines and wherein either of a first pair of said diodes is connectable to form a unidirectional current flow path between said first and second sense lines by actuation of a selected one of a first pair of said selector switches, either of a second pair of said diodes being connectable to form a unidirectional current flow path between said second and third sense lines by actuation of a selected one of a second pair of said selector switches, a third pair of said diodes being connectable to form a unidirectional current flow path between said first and third sense lines by actuation of a selected one of a third pair of said selector switches, said diodes of each of said pairs being oriented to transmit current in opposite directions.

19. An adaptor for coupling a display monitor to a computer which transmits image data to the monitor said adaptor being comprised of:

a first connector having means for engagement with said computer and having a first plurality of signal channels for receiving said image dam from said computer which signal channels include sync signal channels, output means for transmitting said image data to said monitor, said output means having a plurality of signal channels which are connected to said first plurality of signal channels, and manually operable sync signal routing switch means for selectively changing the connections between said sync signal channels of said first connector and said signal channels of said output means.

20. The adaptor of claim 19 wherein said sync signal routing switch means includes a dip switch having a plurality of separately operable switching channels each connected between a separate one of said sync signal channels of said first connector and a separate one of said signal channels of said output means.

* * * * *